United States Patent [19]

Tamary

[11] Patent Number: 4,496,235

[45] Date of Patent: Jan. 29, 1985

[54] FUSER APPARATUS

[75] Inventor: Ernest J. Tamary, Rochester, N.Y.

[73] Assignee: Eastman Kodak Company, Rochester, N.Y.

[21] Appl. No.: 499,638

[22] Filed: May 31, 1983

[51] Int. Cl.[3] ..... G03G 15/20

[52] U.S. Cl. ..... 355/3 FU; 118/60

[58] Field of Search ..... 355/3 FU, 14 FU, 15; 219/216, 469; 432/60; 15/256.51; 118/60, 70, 101, 261, 104

[56] References Cited

U.S. PATENT DOCUMENTS 4,055,143 10/1977 Hattler et al. ..... 118/60
4,258,648 3/1981 Leising et al. ..... 118/60

FOREIGN PATENT DOCUMENTS 56-38520 9/1981 Japan .

OTHER PUBLICATIONS

Xerox Disclosure Journal, vol. 5, No. 2, Mar./Apr. 1980, p. 215, "Lateral Fuser Wick Translator".
Research Disclosure No. 20631, Jun. 1981, "Adjustable Wick for Heated Fuser Roller."

*Primary Examiner*—A. T. Grimley
*Assistant Examiner*—J. Pendegrass
*Attorney, Agent, or Firm*—Donald D. Schaper

[57] ABSTRACT

Apparatus for fusing an unfused toner image to a support through the application of heat and pressure by a fuser member contacting the support. Release material is applied to the fuser member in a uniform layer around its periphery and across its length. When shorter length supports are processed, excess release material which may accumulate at the ends of the fuser member is redistributed towards its center by wiper members positioned at each end of the fuser member.

8 Claims, 9 Drawing Figures

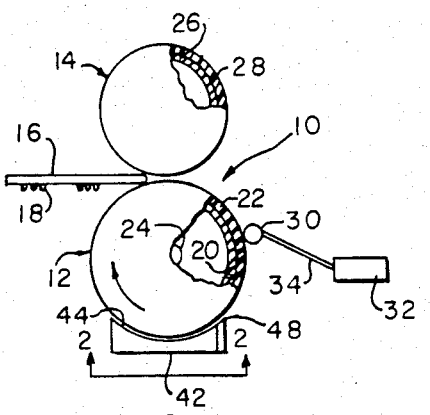
FIG. 1
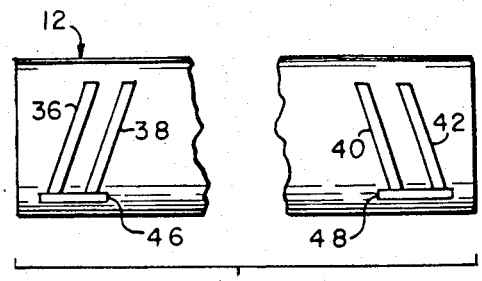
FIG. 2
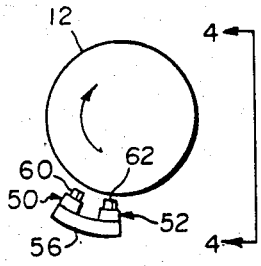
FIG. 3
FIG. 4
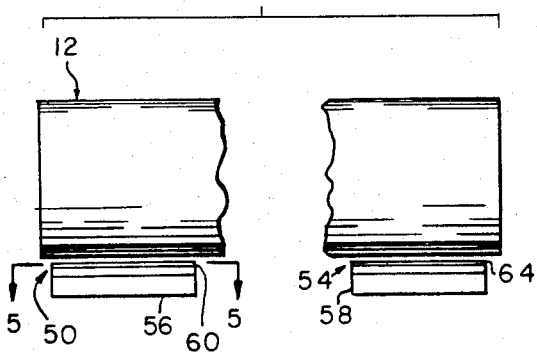
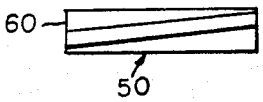
FIG. 5
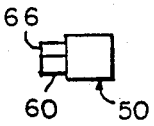
FIG. 6
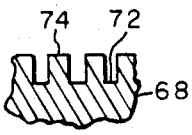
FIG. 9
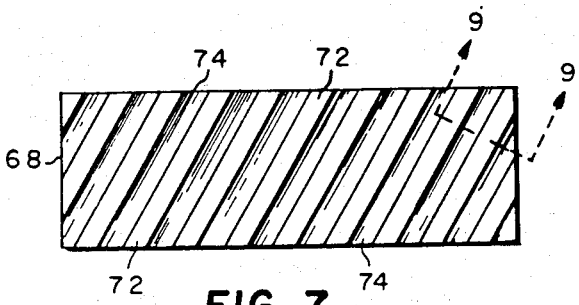
FIG. 7
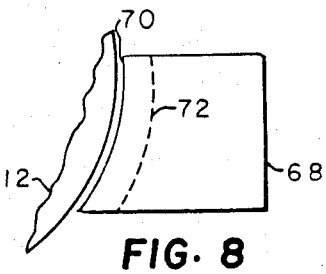
FIG. 8

FUSER APPARATUS

BACKGROUND OF THE INVENTION

This invention relates generally to apparatus for fusing an unfused image to a support by means of heat and pressure. More particularly, this invention relates to fuser apparatus which has release material applied to it across its fusing length in which excess release material accumulated at the ends of the apparatus are redistributed towards the center thereof.

Typically, in the electrographic process an original is illuminated by a light source to form an image which is projected upon a photoconductive member to produce a latent electrostatic image corresponding to the original. The latent image is developed by means of toner particles to produce a toner image which is transferred to a support such as a continuous web or copy sheet of plain paper. The unfused toner image is fixed to the support by means of heat and pressure through contact with a heated fuser member such as a roller. The roller surface is of a material such as polytetrafluoroethylene resin or silicone elastomer which has good release properties to prevent sticking of toner and other debris to it. Typically, a release material such as silicone oil is also applied to the roller surface to improve its release properties.

Release material applied to an elastomeric fuser layer tends to be absorbed, thus causing the elastomer to swell. Where the fuser member contacts supports of different dimensions, such as 11" and 14" paper, differential swelling at the ends of the fuser member occurs if the processing of shorter length supports predominates. When longer supports are then processed, image defects result. Moreover, in such case, release material tends to accumulate at the ends of the fuser member not in contact with the shorter length supports. When longer length supports are run, the excess material is carried off by the first few supports leaving objectionable streaks of release material on the support and making it difficult to write or type on the support.

It is thus desirable that fuser apparatus be provided in which release material may be applied to a fuser member without creating differential swelling of the fuser elastomeric layer, and in which release material applied to the fuser member not build up on the ends of the fuser member when shorter length supports are processed.

SUMMARY OF THE INVENTION

According to the present invention, fuser apparatus is provided including means for fusing an unfused image carried by a support brought into contact with a fusing surface of said fusing means, said surface being coated with release material and means for redistributing excess release material at the ends of said fusing surface towards the center of said surface. According to an aspect of the invention, the fuser means includes an endless fuser member movable around a path and the redistributing means includes wiper members positioned at each end of the endless member for removing excess release material from the ends of said member as it is moved around said path and for redistributing such excess material towards the center of such fuser member.

According to a preferred embodiment of the present invention, the fuser apparatus includes a rotatably mounted roller to which is applied release material across its length. Wiper members are positioned at each end of the fuser roller and are angled inwardly so that as the fuser roller rotates, excess release material accumulated at the ends of the roller is removed and redistributed towards the center of the roller.

The invention and its features and advantages will be set forth and become more apparent in the detailed description of the preferred embodiment presented below.

BRIEF DESCRIPTION OF THE DRAWINGS

In the detailed description of the preferred embodiment of the invention presented below, reference is made to the accompanying drawings, like numbers indicating like elements in which FIG. 1 is a partially sectional elevational side view of fuser apparatus according to the present invention;

FIG. 2 is a bottom-plan view showing the wiper members of the fuser apparatus of FIG. 1;

FIGS. 3 and 4 are respectively side elevational and front elevational views of another embodiment of fuser apparatus according to the present invention;

FIGS. 5 and 6 are respectively top plan and side elevational views of the wiper members shown in FIGS. 3 and 4;

FIGS. 7 and 8 are respectively top plan and side elevational views of a further embodiment of release material redistributing means which may be used in the present invention; and FIG. 9 is a partially sectional elevational view taken along line 9—9 of FIG. 7.

DESCRIPTION OF THE PREFERRED EMBODIMENT

The fuser apparatus according to the present invention is adapted to be used in electrographic apparatus such as that shown and described in commonly assigned U.S. Pat. No. 3,914,047. As disclosed therein, an endless photoconductive member is moved around a path past various work stations. The photoconductive member is charged with an electrostatic charge at a charging station and a light image of a document is projected onto the charged photoconductive member to form a latent electrostatic image corresponding to the illuminated document. The electrostatic image is then developed with toner to produce a toner image which is subsequently transferred to a copy sheet brought into contact with the photoconductive member at a transfer station. The copy sheet carrying the unfused toner image is separated from the photoconductive member and passed through the nip of a roller fuser to permanently fuse the toner image to the copy sheet which is transported to an output tray.

The aforementioned electrographic apparatus processes supports such as copy sheets of at least two dimensions; for example $8\frac{1}{2}'' \times 11''$ sheets and $8\frac{1}{2}'' \times 14''$ sheets. The sheets are transported through the apparatus with their longest dimension transverse to the path of movement of both the photoconductive member and the copy sheet. Thus, the photoconductive member and the work stations of the electrographic apparatus, such as the roller fuser, are dimensioned to process the maximum length sheet. In the roller fuser, release material is uniformly applied to the effective fusing surface of the fuser roller to prevent sticking of toner material and other debris to the roller from the maximum length sheet. Only enough release material is applied to the roller to prevent toner offset and processed sheets carry off minute quantities of release material without affecting the quality of the fused image. However, if shorter length copy sheets are processed more often than longer length copy sheets, excess release material tends to accumulate on the ends of the fuser roller beyond the ends of the shorter length copy sheets. When longer length sheets are then processed, this surplus is carried off resulting in streaking and poor copy quality. The fuser apparatus according to the present invention obviates these difficulties.

Referring now to FIGS. 1 and 2 there is shown one embodiment of fuser apparatus according to the present invention. As shown, roller fuser 10 includes fuser roller 12 and pressure roller 14 which form a nip through which is passed copy sheet 16 carrying a toner image 18. Fuser roller 12 includes a cylindrical core 20 of heat conductive material such as aluminum and an outer layer 22 of heat resistant elastomer such as silicone elastomer which has good release properties. Roller 12 is heated by an internal heat source such as quartz lamp 24. Pressure roller 14 includes a core 26 of aluminum or the like and an outer layer 28 of heat resistant material such as polytetrafluoroethylene which has good release properties.

In order to improve the release properties of fuser roller 12, release material which is liquid at fusing temperatures such as silicone oil, is applied to the surface thereof by means of an applicator roller 30 supplied from a source of release material 32 by means of conduit 34. Applicator 30 applies release oil in a uniform layer around the periphery of and along the maximum fusing length of roller 12. For example, if the maximum sheets to be fused are 14" long, both roller 12 and applicator 30 are at least 14" long and release material is applied uniformly across the 14" fusing length of roller 12.

If shorter length (e.g., 11") copy sheets are run for some time to the exclusion of longer (e.g., 14") copy sheets, release material tend to accumulate on the portions of fuser roller 12 beyond the central 11" area. According to the present invention as shown in FIGS. 1 and 2, wiper members 36 and 38 are positioned at one end of roller 12 and wiper members 40 and 42 are positioned at the other end of roller 12 to redistribute excess release material from the ends towards the center of roller 12. Members 36, 38, 40, and 42 are angled inwardly from the ends of roller 12 and have generally circumferentially extending arcuate lower surfaces such as surface 44 of member 42 which are spaced a predetermined distance from the surface of roller 12. This distance permits a thin layer of release material to be applied across the entire length of roller 12 by applicator 30 while permitting members 36, 38, 40, and 42 to remove excess release material which is not carried off by copy sheets and to redistribute such material towards the center of roller 12 where it will be carried off in minute portions by shorter length copy sheets. Members 36 and 38 are mounted on bracket 46 and members 40 and 42 are mounted on bracket 48, brackets 46 and 48 being secured to the fuser frame. Members 36, 38, 40, and 42 are of a material such as polytetrafluoroethylene which is stable at fusing temperatures.

During operation of electrographic apparatus 10, roller 14 is in pressure engagement with fuser roller 12. Roller 14 is preferably mounted for movement toward and away from roller 12 by a suitable mechanism such as that disclosed and described in commonly assigned U.S. Pat. No. 4,232,959.

Although pairs of wiping member 36–38, 40–42 are shown mounted on each end of roller 12 to effect redistribution of excess release material from the ends of roller 12 towards the center thereof, it will be understood that fewer or greater number of wiper members may be provided. Although members 36, 38, 40, and 42 are shown as extending linearly, it will be understood that such members may also have other configurations, e.g. they may be curved.

Referring now to FIGS. 3–6, there is shown another embodiment of the fuser apparatus of the present invention. As shown, fuser roller 12 has located at each end wiper members 50, 52, and 54 which extend generally axially of roller 12. Members 50 and 52 are located at the left end of roller 12 (FIG. 4) and member 54 and another member (not shown) are located at the right end. Members 50 and 52 are mounted on bracket 56 and member 54 is mounted on bracket 58. Members 50 and 52 respectively includes blades 60 and 62 and member 54 includes blades 64 which are angled inwardly (FIG. 5) so as to redistribute excess release material away from the ends towards the center of roller 12. Blades 60, 62, and 64 preferably have curved end walls such as wall 66 of wiper 60 to conform to the curvature of roller 12.

Members 52 and 54 are positioned generally circumferentially around roller 12 and it will be understood that more or less such members may be provided.

FIGS. 7, 8 and 9 show another embodiment of wiper member which may be used in the fuser apparatus of the present invention. As shown, wiper member 68 is to be located at the left end of fuser roller 12 and includes grooved wall 70 facing roller 12. Wall 70 includes alternating grooves 72 and lands 74 which are angled towards the center of roller 12. Wall 70 is curved to conform to the curvature of roller 12. It will be understood that a wiper member similar to member 68 is located on the right end of roller 12 but has a wall facing roller 12 which is grooved in the opposite direction. Both members redistribute excess release material accumulated at the ends of roller 12 towards the center thereof.

The invention has been described in detail with particular reference to preferred embodiments thereof; however, it will be understood that variations and modifications can be effected within the spirit scope of the invention.

What is claimed is:

1. Fuser apparatus comprising;

a rotatably mounted roller for fusing an unfused image carried by a support moved along a path, said roller having a length to fuse supports of a predetermined maximum dimension and also shorter dimensioned supports;

means for applying release material to said roller across its length; and means for redistributing excess release material applied to said roller in the region between the ends of said shorter length support and the ends of said predetermined maximum length toward the portion of said roller which contact said shorter length support material.

2. The fuser apparatus of claim 1 wherein said redistributing means includes wiper members located at the ends of said roller and positioned to remove excess release material from said ends of said roller and to redistribute it towards the center of said roller.

3. The fuser apparatus of claim 2 wherein said wiper members are angled inwardly.

4. The fuser apparatus of claim 2 wherein said wiper members extend generally circumferentially about said fuser roller.

5. The fuser apparatus of claim 2 wherein said wiper members extend generally axially along said fuser member.

6. The fuser apparatus of claim 2 wherein said wiper members include a grooved surface facing said roller.

7. Fuser apparatus comprising means having a fusing surface for fusing an unfused image carried by a support brought into contact with said surface, said surface (1) being dimensioned to fuse supports of a maximum predetermined dimension and supports of at least one lesser dimension and (2) being coated with release material; and means for removing excess release material in the areas of said fusing means surface between the ends of said lesser dimensioned support and the ends of said maximum dimensioned support and for redistributing such removed release material to the portion of said surface in contact with said lesser dimensioned support.

8. Fuser apparatus comprising:

means for fusing an unfused image carried by a support, said fusing means including an endless fuser member (1) which is movable around a path, (2) which has a fusing surface contacting said support and being coated with release material, and (3) which is dimensioned to fuse supports of a maximum predetermined length and supports of at least one shorter length; and means for redistributing excess release material at the ends of said fusing surface towards the center of said fusing surface, wherein said redistributing means includes at least one wiper member positioned at each end of said endless member for removing from said member as it is moved around said path excess release material located in the portions of said member between the ends of said shorter length support and the ends of said maximum length support and for redistributing such removed excess material to the portion of said fuser member in contact with said shorter length support.

* * * * *